US005492662A

United States Patent [19]

Kargol et al.

[11] Patent Number: 5,492,662

[45] Date of Patent: Feb. 20, 1996

[54] PROCESS FOR FORMING MULTIPLE DENSITY BODY FROM FIBROUS POLYMERIC MATERIAL AND VEHICLE SEAT COMPONENT FORMED THEREBY

[76] Inventors: James A. Kargol, 21656 Manchester Ct., Farmington Hills, Mich. 48335; Gregary A. Haupt, 59669 Sunridge, New Hudson, Mich. 48165

[21] Appl. No.: 324,219

[22] Filed: Oct. 17, 1994

[51] Int. Cl.[6] ..... B29C 59/02

[52] U.S. Cl. ..... 264/119; 264/122; 264/125; 5/474; 297/452.48; 297/DIG. 2; 425/356; 428/171; 428/218

[58] Field of Search ..... 264/119, 122, 264/125, 318; 428/171, 218; 5/474; 425/356; 297/452.21, 452.27, 452.29, 452.37, 452.48, DIG. 2

[56] References Cited

U.S. PATENT DOCUMENTS

| | | | |
|---|---|---|---|
| 3,809,736 | 5/1974 | Munk | 425/356 |
| 4,892,695 | 1/1990 | Bainbridge et al. | 264/119 |
| 5,000,515 | 5/1991 | Deview | 297/DIG. 2 |
| 5,082,720 | 1/1992 | Hayes | 428/224 |
| 5,169,580 | 12/1992 | Marcus | 264/126 |
| 5,252,270 | 10/1993 | Haardt et al. | 264/126 |
| 5,366,678 | 11/1994 | Nomizo et al. | 264/122 |

*Primary Examiner*—Robert A. Dawson
*Assistant Examiner*—Kenneth M. Jones
*Attorney, Agent, or Firm*—Harness, Dickey & Pierce

[57] ABSTRACT

An improved method of making a more comfortable and easily recyclable body for a vehicle seat component using thermoplastic polymeric fibers is described. This method produces a body of thermoplastic polymeric fibers consisting of zones of different densities.

2 Claims, 3 Drawing Sheets

PROCESS FOR FORMING MULTIPLE DENSITY BODY FROM FIBROUS POLYMERIC MATERIAL AND VEHICLE SEAT COMPONENT FORMED THEREBY

BACKGROUND OF THE INVENTION

This invention relates generally to the field of vehicle seating where comfort, durability, efficiency in production and recyclability are important goals. This invention uses a novel process to create a multiple density body of thermoplastic polymer fibers.

Recently, improved materials have been developed in the field of vehicle seat components such as thermoplastic polymeric fibers. Seat components made from these thermoplastic fibers are more breathable than the traditional polyurethane foam and are also more easily recyclable. However, there is room for improvement in the support provided by seats made from the thermoplastic fibers. Thermoplastic fiber bodies with zones of different densities have been shown to improve the support, comfort and durability of vehicle seats. In the current invention, improved techniques for creating high and low density zones in a body of a vehicle seat component are described.

Conventional foam vehicle seats have been made with multiple density zones as disclosed in U.S. Pat. No. 5,000,515, issued Mar. 19, 1991 to Deview, entitled "Variable Density Foam Vehicle Seat". In this method, expandable foam is injected into a mold cavity where the mold cavity is partitioned into density zones using cloth barriers. Expandable foam materials of differing densities are used. The foam with the appropriate density is injected into each zone.

In contrast, the current invention does not require two chemically different fill materials. Instead, the higher density zones of this invention simply contain more polymeric fibers relative to the zone volume than the lower density zones. Therefore the manufacturing process for this invention will require less chemical processing than the multiple density foam vehicle seat disclosed in U.S. Pat. No. 5,000,515. Additional advantages such as recyclability, improved breathability and the ability to use a very efficient one-step process are inherent in the choice of polymeric fibers over polyurethane foam for the body of a vehicle seat component.

CROSS-REFERENCE TO COPENDING APPLICATION

The field of this invention generally relates to the field of the inventions disclosed in copending applications Ser. No. 08/324,218 filed on Oct. 17, 1994 and Ser. No. 08/324,220 filed on Oct. 17, 1994, assigned to the assignee of this application.

SUMMARY OF THE INVENTION

This invention is a method to manufacture a body of a vehicle seat component having zones of different densities using thermoplastic polymeric fibers.

The body of polymeric fibers is molded into shape by a heat bonding process. Some of the polymeric fibers will be provided with a thermoplastic polymer coating that melts at a relatively low temperature. The function of this polymer coating is to bind the polymeric fibers to each other.

A polymer is a substance whose composition is characterized by multiple repetition of one or more species of atoms or groups of atoms linked to each other. A thermoplastic polymer refers to a polymer which is capable of being repeatedly softened by heating and hardened by cooling through a characteristic temperature range.

The mold apparatus used to carry out this invention consists of a mold cavity surrounded by a lower mold member and an upper mold member. The mold cavity, when closed, has a shape corresponding to the desired shape of the seat component and is equipped to supply a hot atmosphere, such as hot air or steam, to the mold cavity.

The multiple density vehicle seat component is formed by a compression and bonding process. Generally, the process comprises placing the fabric cover to line the lower mold member and placing the polymeric fibers in the mold cavity such that more fibers occupy the areas where a higher density zone is desired. The upper mold member is then lowered into place compressing the loose polymeric fibers. Many contact points are formed between the fibers with a polymeric coating and the uncoated fibers.

Forced convection is then used to pass a heated atmosphere through the mold cavity. As the hot air or steam moves through the cavity, the polymeric sheath which is on some of the fibers will melt and flow over the adjacent uncoated fibers at the many contact points. Once the seat component has cooled so that the polymeric bonds have solidified, the mold cavity can be opened and the seat component will retain its shape.

An important aspect of creating a multiple density seat is the separation of the high and low density zones. A smooth density transition between the zones is necessary so that there is no void or air pocket at the interface. In this invention, a comb-like separation tool can be placed along the high-to-low-density interface in the pad mold cavity.

During the fiber filling procedure, the polymeric fibers will pile up along the combed teeth and will not completely fall through to the opposite side of the comb. A non-stick coating can be placed on the comb teeth which will aid in comb retraction without disturbing the distribution of the polymeric fibers.

An alternate method of creating the density zones involves vertically movable segments of the lower mold member. Each different density zone of the body corresponds to a separate movable segment of the lower mold member. When the mold apparatus is in the initial pre-filling position, these separate mold segments rest at different levels. The segments corresponding to high density zones rest at a lower level so that relatively more fiber will be placed on top of that mold segment. The mold segments corresponding to lower density zones rest at a higher level. Therefore, polymeric fibers can be added to the mold cavity to produce a level horizontal surface where more polymeric fibers will be placed in the higher density zones. Because the cavity is filled so that the top surface is level before the mold is compressed, consistency of fill is easy to verify before bonding. The compression step for this alternative is slightly different than when the comb inserts are used. The fabric cover is clamped in place over the horizonal top surface of polymeric fibers in the mold cavity. The top mold member is lowered down onto the fabric cover and the polymeric fibers. At the same time, the movable mold segments that comprise the bottom mold member moved vertically to preset positions, thereby differentially compressing the fibers within the mold cavity.

Additional objects and advantages of the invention will become apparent from the following description and the appended claims when considered in conjunction with the accompanying drawing in which:

DESCRIPTION OF THE PREFERRED EMBODIMENT

Figure 5:
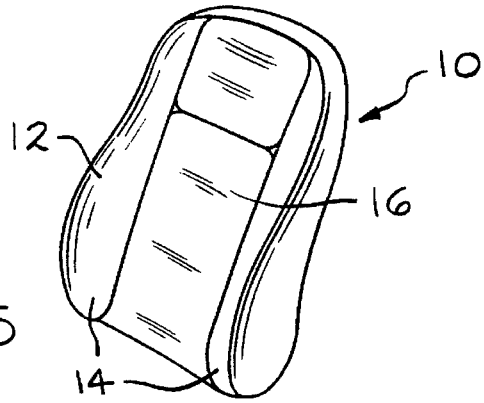
FIG. 5 is a perspective view of a completed seat component consisting of a fibrous body with zones of different density and a fabric cover laminated to the body.
Figure 8:
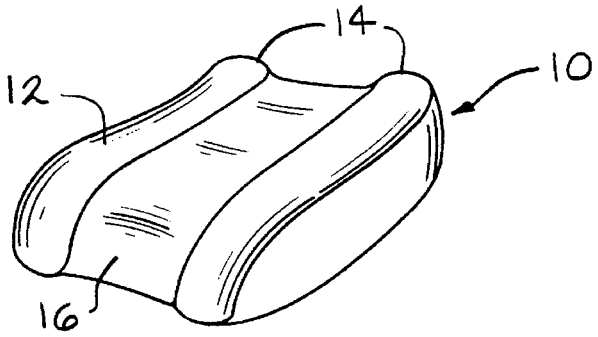
FIG. 8 is a perspective view of a completed seat component consisting of a fibrous body with zones of differing density and a fabric cover laminated to the body.

With reference to the drawing, the seat component of this invention is shown generally at 10 in FIGS. 5 and 8 as including a fabric cover 12 and a body or pad of molded polymeric fibers consisting of zones of higher density 14 and lower density 16. An improved method for creating a multiple density body from fibrous polymeric material and laminating fabric to the body is disclosed in this invention. The polymeric fibers used in this invention are chosen from the group defined as thermoplastic fibers, which include polyester, nylon and others depending on practicing limitations. The use of polyester fibers is preferable because polyester is easily recyclable. More specifically, polyethylene terephthalate (PET) polyester offers the advantages of being easily recyclable, and having flame retardant variants. In order to create bonds between the polymeric fibers, at least a portion of the polymeric fibers which comprise the body will be coated with a fusable polymeric material. When the upper mold member 18 is lowered to compress the polymeric fibers, many contact points are created between the coated and uncoated fibers. Then, a heated atmosphere is passed through the mold cavity, causing the coating to melt and flow onto adjacent fibers. These contact points cool to form the bonds which hold the body in the desired shape.

The bonding qualities of the polymeric coating may also be used to laminate the fabric cover 12 to the body of polymeric fibers. If at least a potion of the mold cavity is lined with the fabric cover 12 before the hot atmosphere is passed through the cavity, the melted polymeric coating will flow onto the fabric cover. This preferred alternative is an efficient, one-step process to both form the body and laminate the fabric cover 12 to the body. Alternatively, the fabric cover could be attached by adhesive or stitching after the body is formed.

The polymeric coating material is selected to have a melting temperature relatively lower than the core of the polymeric fiber. Examples of coating polymers are copolyester, polyethylene, and activated copolyolefin. Where PET is used for the core material, a copolymer of PET is used for the coating. The melting temperature of the PET copolymer coating is in the range of 110°–220° C. (250°–428° F.), while the PET core melts at approximately 260° C. (500° F.).

The thermoplastic fibers could be utilized in the form of non-woven batting, clusters, loose fibers or in other forms known to those skilled in the art. Preferably, fiber clusters having a one quarter inch diameter will be used, such as Ecofil polyester fill fibers made by E. I. du Pont De Nemours and Company of Wilmington, Del. Alternatively, Celbond polyester can be used to make densified batting, manufactured by Hoechst Cellanese Corporation of Somerville, N.J.

In a preferred embodiment, the entire vehicle seat component 10 of this invention can be made totally reclaimable if the fabric cover member 12 and the polymeric fibers are both made from polyester. An example of the available material for the fabric cover 12 is Dacron polyester made by DuPont.

A mold apparatus for making the vehicle seat component of this invention is shown in FIGS. 1–4, as including a mold assembly 20 consisting of an upper mold member 18 and a lower mold member 22 which cooperate to form and enclose a mold cavity 24, and removable comb inserts 26. The mold cavity 24 may be enclosed by porous material in order to admit the hot atmosphere which is supplied by a steam or hot air inlet member 28 and expelled by a pressurized exhaust member 30. For ease of illustration, hot atmosphere vents 32 are shown in the upper 18 and lower 22 mold members which could alternatively be used to supply the hot atmosphere.

The comb insert 26 consists of spaced teeth which point in the direction of comb insertion. In determining the comb teeth spacing, a balancing must occur between two important goals. First, the high and low density regions must be sufficiently separated to maintain their density difference. Second, loose fiber contact must be permitted between the zones in order to prevent air pockets or void formations and to allow bonding between the high and low density areas. If loose fibers are used for the body, then the spacing of the comb teeth should be as far apart as possible such that fibers do not migrate across the comb. The actual comb tooth spacing is determined by the effective length of a crimped loose fiber, the fiber-to-fiber frictional force, and degree of fiber entanglement. The effective length is measured when the fiber is straightened but not stretched. If fiber clusters are used for the body, then the mean fiber cluster dimension should determine comb tooth spacing.

Figure 1:
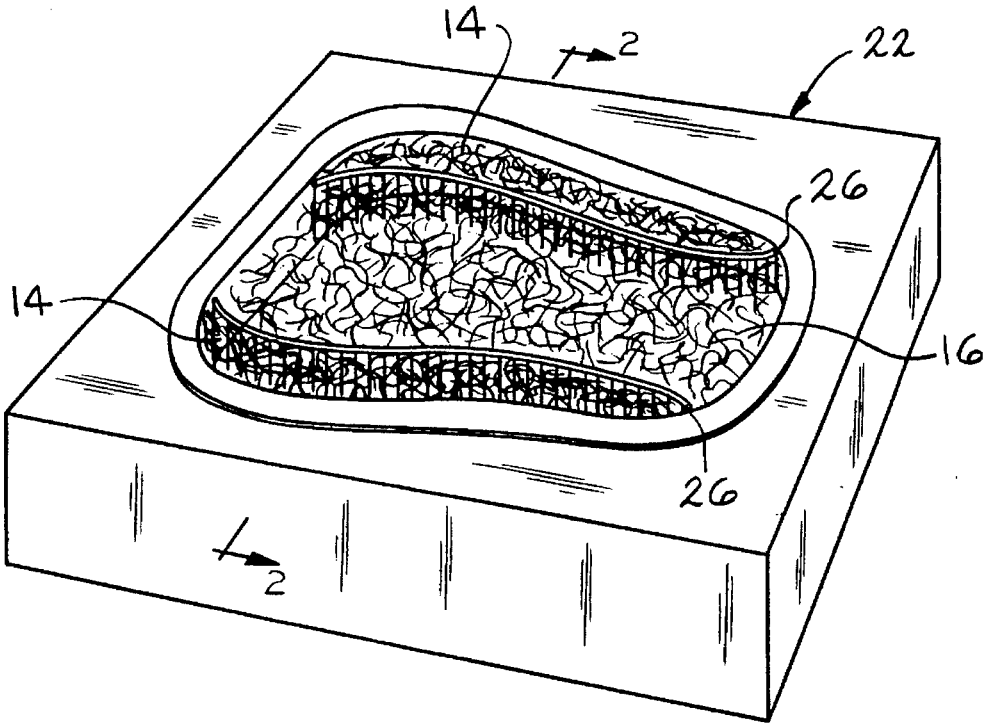
FIG. 1 is a perspective view of the lower mold member with the removable comb inserts separating zones of higher and lower density polymeric fibrous material.
Figure 2:
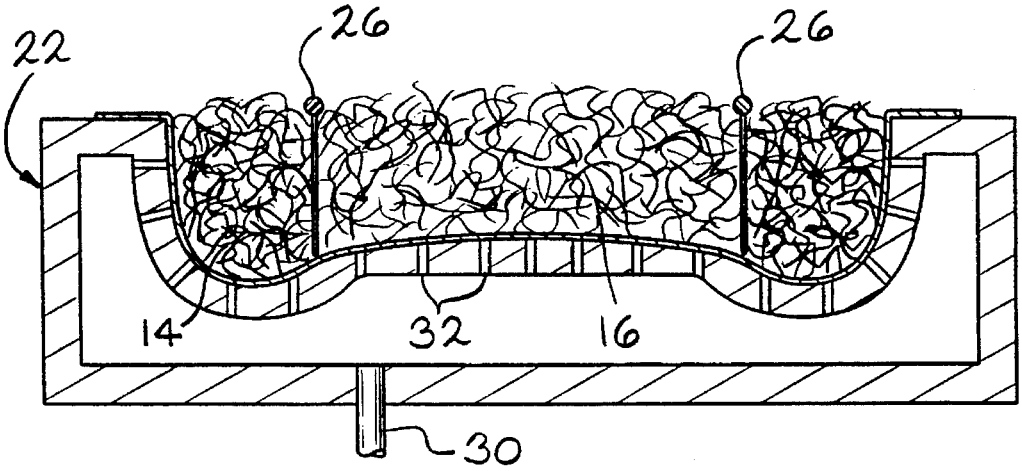
FIG. 2 is an exploded cross-sectional view of the lower mold member, as viewed from line 2 of FIG. 1, with removable comb inserts separating higher and lower density zones of polymeric fibrous material.
Figure 3:
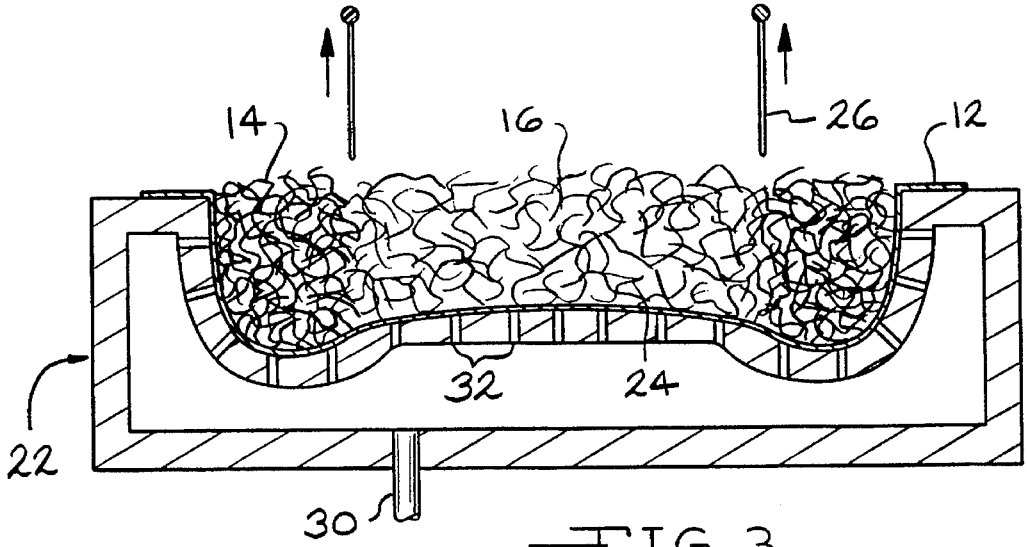
FIG. 3 is an exploded cross-sectional view like FIG. 2 showing the lower mold member with higher and lower density zones of polymeric fibrous material as the comb inserts are removed.
Figure 4:
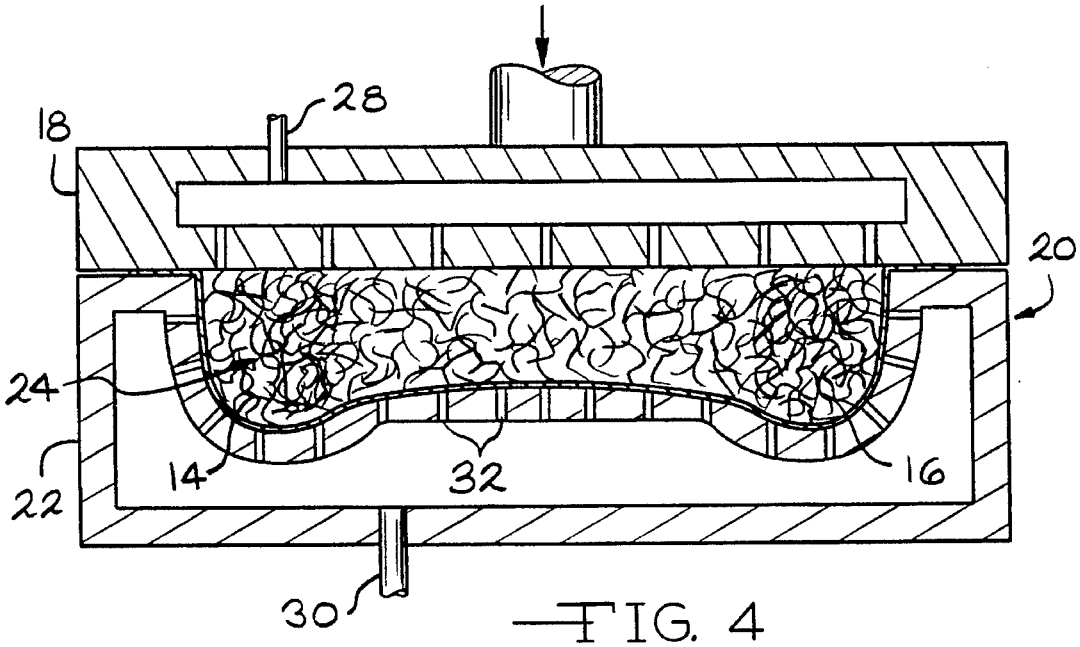
FIG. 4 is an exploded cross-sectional view like FIG. 3 where the mold apparatus is closed with the fibrous polymeric material in higher and lower density zones shown inside the mold cavity.

The method of carrying out this invention using the mold apparatus shown at 20 is illustrated in FIGS. 1–4. The process of the preferred embodiment of the present invention comprises placing the fabric cover member 12 to line the lower mold member 22 and positioning the removable comb inserts 26 along the desired boundaries between the higher 14 and lower 16 density zones. A predetermined amount of loose, polymeric fiber is then placed inside the mold cavity 24, with proportionately more polymeric fibers being placed inside the higher density zones 14. The comb inserts 26 are then removed from the mold cavity 24 as shown in FIG. 3. The upper mold member 18 is lowered down onto the apparatus as shown in FIG. 4, compressing the loose polymeric fibers.

The hot atmosphere used to bond the thermoplastic polymeric fibers is supplied through numerous steam or hot air vents 32 placed in the upper mold member 18, and is drawn through the mold cavity 24 by additional vents 32 in the lower mold member 22. A porous mold cavity may also be used to admit the hot atmosphere. The temperature of the hot atmosphere must be sufficient to cause the coating on at least some of the polymeric fibers to melt and flow over the other coated and uncoated fibers, and the fabric cover 12. When the seat component has cooled and the polymeric bonds have formed, the vehicle seat component 10 shown in FIG. 5 is produced.

Figure 6:
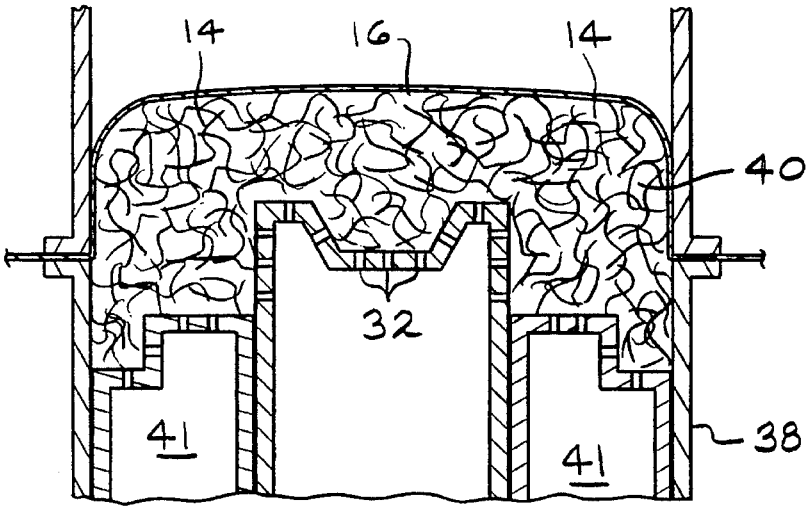
FIG. 6 is a cross-sectional view of the lower mold member showing the movable mold segments in their initial position covered by the fibrous polymeric material, with a fabric cover secured in place.
Figure 7:
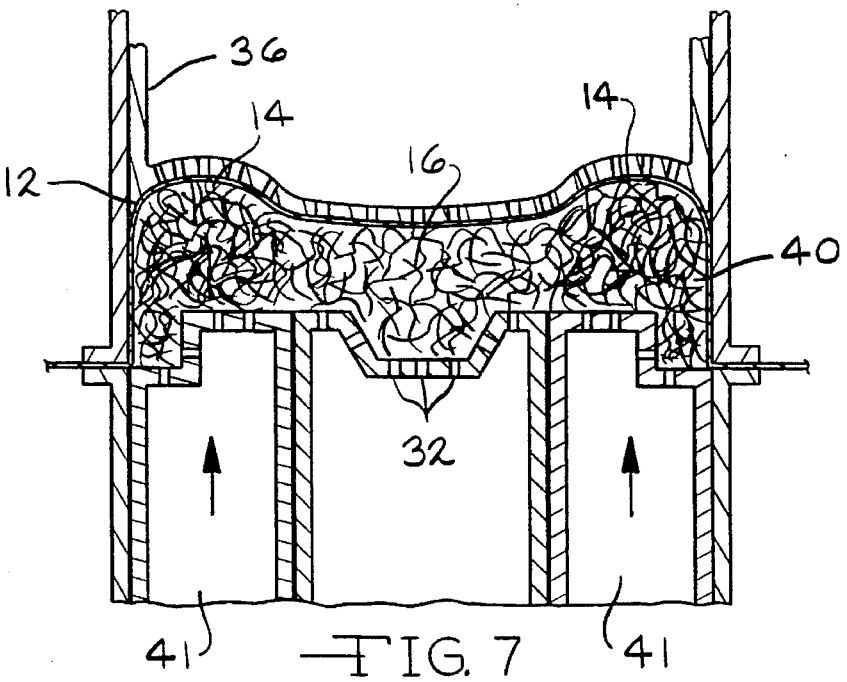
FIG. 7 is a cross-sectional view of the mold apparatus where the movable mold segments are differentially compressing the polymeric fibrous material and the upper mold member is lowered.

An alternate mold apparatus for making the multiple density seat component of this invention is shown in FIGS. 6 and 7 as including a mold assembly 34 consisting of an upper mold member 36 and a lower mold member 38 which cooperate to form and enclose a mold cavity 40. The lower mold member 38 consists of movable mold segments 41 which correspond to zones of differing density within the pad. The method of carrying out this invention using the alternate mold apparatus is illustrated in FIGS. 6 and 7. First, the movable mold segments 41 are set at their initial positions, where areas corresponding to desired higher density zones 14 have the movable mold segments set at a lower level than where lower density zones 16 are desired. Next, the polymeric fibers are placed on top of the movable mold segments 41 so that a level horizontal surface is formed. Next, a fabric cover 12 may be placed over the horizontal surface so that it partially lines the sides of the mold cavity 40 where it is secured in place. Next, the upper mold member 36 is lowered onto the mold cavity 40. The movable mold segments 41 are moved vertically, horizontally, or a combination thereof to preset positions so that they force the polymeric fibers above each component to differentially compress, producing multiple densities in the fiber body. A thermal bonding process is then executed as previously described.

The load carrying surface of the multiple density seat component can be formed by either the upper 36 or the lower mold member 38. This novel method will work equally well if the movable mold components 41 comprise the upper mold member 36, and differentially compress the fibers with a downward motion. However, the use of upper mold segments does not allow for a well defined levelled horizontal surface as a reference to insure full and uniform fiber fill.

The method of this invention will produce a vehicle seat component 10 made of thermoplastic fibers which has superior comfort, durability, and support quality. The use of thermoplastic fibers will enhance the breathability and recyclability of this vehicle seat component over those of the prior art.

Variables in the production process such as the quantity of fibrous polymeric material, the dimensions of the mold cavity, comb inserts, and movable mold segments, and the degree of compression required will all be dictated by the desired dimensions and density of the resulting vehicle seat component. These quantities can easily be determined by one skilled in the art. Those skilled in the art can now appreciate that this invention can be implemented in a variety of forms. Therefore, while this invention has been described in connection with particular examples, the true scope of the invention should not be so limited, since other modifications will be apparent to the skilled practitioner upon a study of the drawings, specification, and the following claims.

What is claimed:

1. The method of forming a body of thermoplastic polymeric fibrous material having selected areas of different densities, said method comprising the steps of:

a. providing a mold cavity with means for establishing and maintaining zones for different densities of polymeric fibers during a compression and bonding process, b. placing selected amounts of thermoplastic polymeric fiber in the zones so that the fibrous material in the zones are of different density, c. providing a polymeric coating having a low melting point on at least some of said polymeric fibers, d. compressing the mold cavity so that said fibrous polymeric body is held in the desired shape, e. passing a heated atmosphere through the mold cavity at a temperature sufficiently high to melt said polymeric coating and cause the coating to flow in quantities sufficient to maintain said fibrous body in the desired shape when cooled; and f. cooling said fibrous body.

2. The method according to claim 1 wherein the said zones for different densities of fibrous material are arranged so that each zone is adjacent another of said zones and limited access is provided between said zones for fibers and melted coating material so that a bonding of said adjacent zones takes place following cooling.

* * * * *